United States Patent [19]

Biek

[11] Patent Number: 4,836,296

[45] Date of Patent: Jun. 6, 1989

[54] FLUID PRESSURE IMPULSE NUT RUNNER

[75] Inventor: Paul A. Biek, Houston, Tex.

[73] Assignee: Dresser Industries, Inc., Dallas, Tex.

[21] Appl. No.: 234,531

[22] Filed: Aug. 22, 1988

[51] Int. Cl.[4] ..... B25D 15/00

[52] U.S. Cl. ..... 173/93.5; 81/463; 464/25

[58] Field of Search ..... 173/90, 93.5, 94, 93; 81/463, 464; 464/25, 24

[56] References Cited

U.S. PATENT DOCUMENTS

| | | | |
|---|---|---|---|
| 2,565,289 | 8/1951 | Zak | 464/28 |
| 2,730,877 | 1/1956 | Suberrub | 464/26 |
| 3,116,617 | 1/1964 | Skoog | 464/26 |
| 3,182,470 | 5/1965 | Smith | 464/25 |
| 3,191,404 | 6/1965 | Schivley, Jr. | 464/25 |
| 3,192,739 | 7/1965 | Brown | 464/25 |
| 3,199,314 | 8/1965 | Schrader | 464/25 |
| 3,203,204 | 8/1965 | Brown | 464/25 |
| 3,210,960 | 10/1965 | Vaughn | 464/25 |
| 3,214,940 | 11/1965 | Kramer | 464/25 |
| 3,263,426 | 8/1966 | Sckoog | 464/25 |
| 3,263,449 | 8/1966 | Kramer | 464/25 |
| 3,283,537 | 11/1966 | Gillis | 464/25 |
| 3,292,369 | 12/1966 | Skoog et al. | 464/25 |
| 3,292,391 | 12/1966 | Kramer et al. | 464/25 |
| 3,304,746 | 2/1967 | Kramer et al. | 464/25 |
| 3,334,487 | 8/1967 | Pauley | 464/25 |
| 3,672,185 | 6/1972 | Schoeps | 173/93 X |
| 3,717,011 | 2/1973 | Vana | 464/25 |
| 3,858,444 | 1/1975 | Wallace | 173/12 X |
| 3,989,113 | 11/1976 | Spring et al. | 173/163 |
| 4,019,589 | 4/1977 | Wallace | 173/12 |
| 4,042,062 | 8/1977 | Tooley | 181/36 |
| 4,084,487 | 4/1978 | Wallace | 91/325 |
| 4,147,219 | 4/1979 | Wallace | 173/12 |
| 4,175,408 | 11/1979 | Kasai | 173/93.5 X |
| 4,265,108 | 5/1981 | Wallace et al. | 73/862.21 |
| 4,347,902 | 9/1982 | Wallace et al. | 173/93.5 |
| 4,429,775 | 2/1984 | Teramoto | 192/0.096 |
| 4,497,197 | 2/1985 | Giardino et al. | 72/453.17 |
| 4,533,337 | 8/1985 | Schoeps | 464/25 |
| 4,553,948 | 11/1985 | Tatsuno | 173/93.5 |
| 4,557,337 | 12/1985 | Shibata | 173/93.5 |
| 4,766,787 | 8/1988 | Sugimoto et al. | 173/93.5 X |
| 4,767,379 | 8/1988 | Schoeps | 173/93.5 |

OTHER PUBLICATIONS

Instruction and Parts Book, Impulse tools, Chicago Pneumatic, CP-5435, Jan. 1985, "Acra-Pulse Impulse tools", brochure, 6-3-86.

"LTV 46 Angle Nut Runner", brochure Boulonneuse Mutterdragane Schromber Impulse Tools Instruction Manuals.

*Primary Examiner*—Frank T. Yost

*Assistant Examiner*—Willmon Fridie, Jr.

[57] ABSTRACT

An impulse unit (10) is disclosed which provides for a symmetric transfer of torque between a case (16) and spindle (18) selectively for one or two impulses for each relative rotation between the case and spindle. A pair of cylindrical rollers (84, 86) is provided to isolate two symmetric chambers between the case and spindle to transfer torque therebetween. The use of cylindrical rollers reduces the overall wear in the tool, improves oil sealing capability during long time use, and reduces the cost of manufacture.

14 Claims, 2 Drawing Sheets

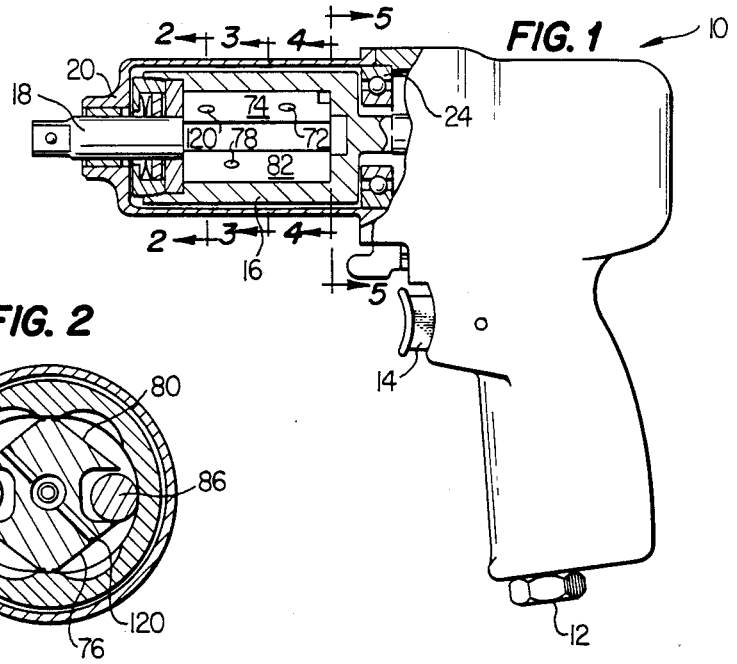
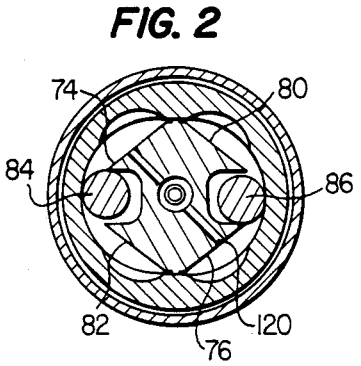
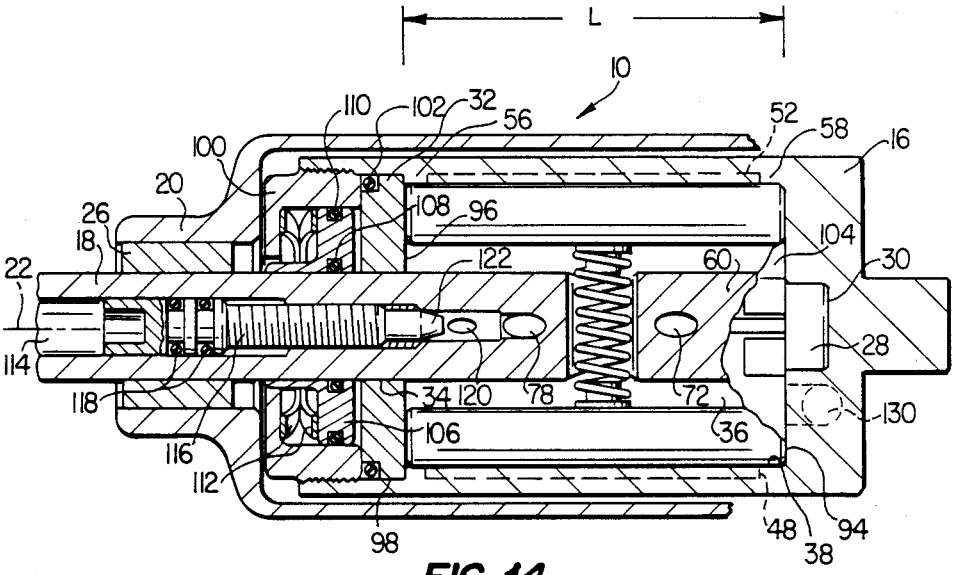
FIG. 14

FLUID PRESSURE IMPULSE NUT RUNNER

FIELD OF THE INVENTION

This invention relates to the art of impulse driving tools, such as nut runners.

BACKGROUND OF THE INVENTION

Fluid operated torque impulse units are known in the art. Examples of such units are shown in U.S. Pat. No. 4,347,902, issued Sept. 7, 1982 to William K. Wallace. Other examples are shown in U.S. Pat. No. 3,116,717 to Donald D. Skoog, U.S. Pat. No. 3,263,449 to Leo Kramer, and U.S. Pat. No. 4,553,948 to Koji Tatsuno.

While previous impulse unit designs have proven generally satisfactory, prior art units do suffer certain disadvantages. Prior designs inherently have a non-symmetrical force distribution between the driving element and the driven element. This creates significant vibration in the units, high internal bearing journal loads and excessive mechanical wear between moving parts.

In the art, there are often requirements for a unit which delivers two torque impulses for each revolution of the driving element, while other requirements employ a single impulse per revolution of the driving element. This has generally required two different fundamental designs of operation, with resulting duplication of cost and effort.

Further, many prior art designs are complicated and expensive to produce. Often, the prior art designs require careful assembly of fragile or awkwardly shaped parts, resulting in costly manufacture. Therefore, a need exists for an impulse unit which overcomes the disadvantages of the prior art.

SUMMARY OF THE INVENTION

In accordance with one aspect of the present invention, an impulse unit is provided which provides a case and a spindle. The case includes an interior cylindroidal cavity formed by three overlapping and parallel cylindrical bores, with the middle bore centered on a first axis. As a result, the walls of the cavity have a generally elliptical cross section perpendicular the first axis, with a minor axis and a major axis. First and second seal lands are formed on the wall on opposite sides of the first axis and centered on the minor axis. The spindle is mounted to the case for relative rotation between the case and spindle about the first axis. The spindle extends through the internal cavity of the case and has an outer surface which defines first and second seal lands which extend parallel to the first axis on opposite sides of the first axis. A first recess is formed in the outer surface of the spindle between the lands, the recess extending parallel to the first axis for the length of the cavity. A second recess is formed into the outer surface of the spindle on the opposite side of the first axis from the first recess, the second recess also extending parallel to the first axis the length of the cavity.

A first cylindrical roller is provided having a length equal to the length of the cylindroidal cavity which is partly received within the first recess for simultaneous contact with the surface of the first recess and the wall of the cavity. A second cylindrical roller is provided which also has a length equal to the length of the cavity and which is partly received within the second recess for simultaneous contact with the surface of the second recess and the wall of the cavity. Structure is provided for maintaining fluid in the cavity in the space between the case and spindle and for rotating either the case or the spindle relative the other about the first axis. Alignment of the first seal land on the spindle and the first seal land on the case as the case and spindle rotate relative each other temporarily isolates a first chamber between the first seal lands and the first roller. Simultaneously, alignment of the second seal lands temporarily isolates a second chamber, symmetric to the first chamber, between the second seal lands and the second cylindrical roller to fluidically couple the case and spindle for joint rotation to create a torque impulse.

In accordance with another aspect of the present invention, a passage extends through the spindle, the passage opening through the outer surface between the first seal land and the first recess and between the second seal land and the second recess to equalize the pressure forces in the symmetric first and second chambers. In accordance with another aspect of the present invention, structure is provided for urging each of the cylindrical rollers against the wall of the cylindroidal cavity. Further, pockets can be formed in the walls of the cavity in the first and second chambers to enhance the torque impulse. Structure can be provided for controlling the release of pressurized fluid from the first and second chambers during the torque impulse to control the torque output.

In accordance with another aspect of the present invention, bypass passages can be provided in the spindle and case to permit free fluid flow in the space between the walls of the cylindroidal cavity and the outer surface of the spindle as the case and spindle continue to rotate relative each other about the first axis as the first seal land on the case aligns with the second seal land on the spindle to provide only a single torque impulse for a complete relative rotation between the case and the spindle. However, the bypass passages can be blocked to generate a second torque impulse for each relative rotation between the case and spindle as the first seal land of the case aligns with the second seal land of the spindle.

BRIEF DESCRIPTION OF THE DRAWINGS

A more complete understanding of the invention may be had by reference to the following Detailed Description, when taken in conjunction with the accompanying drawings, where:

FIG. 1 is a side view in partial cross section of an impact unit forming a first embodiment of the present invention;

FIG. 2 is a cross sectional view of the impulse unit along line 2—2 in FIG. 1;

FIG. 14 is a side view in partial cross section of the impulse unit.

DETAILED DESCRIPTION

Figure 3:
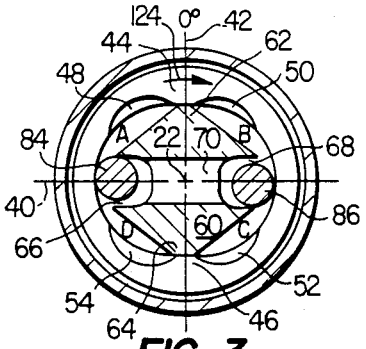
FIG. 3 is a cross sectional view taken along line 3—3 in FIG. 1 illustrating the case and spindle in the impulse generating orientation.
Figure 4:
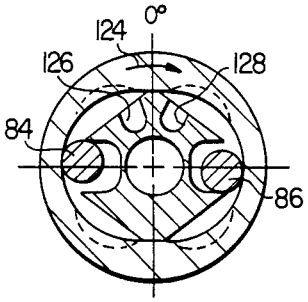
FIG. 4 is a cross sectional view of the case and spindle taken along line 4—4 in FIG. 1.
Figure 5:
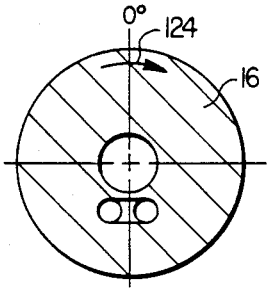
FIG. 5 is a cross-sectional view of the case and spindle taken along line 5—5 in FIG. 1.
Figure 6:
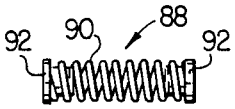
FIG. 6 is a side view of the spring assembly urging the cylindrical rollers against the wall of the cylindroidal cavity in the case.

Referring now to the drawings, wherein like reference characters designate like or corresponding parts throughout the several views, and in particular to FIG. 1, an impulse unit 10 is illustrated which forms a first embodiment of the present invention. The impulse unit 10 can comprise a nut runner, impact wrench, or any other impulse driven rotary tool.

The unit 10 has a pistol like configuration with an inlet 12 to power the unit. Most typically, the inlet 12 will provide the connection between the unit and a compressed air source. A trigger mechanism 14 controls the flow of compressed air from inlet 12 to a radial vane motor (not shown) which converts the potential energy of the compressed air into rotational motion of a cylindrical case 16 within the unit. Details of the motor are not shown as its construction is conventional and well known in the art and only forms part of the present invention in providing a means for rotating the case 16.

With reference to FIGS. 1 and 14, the case 16, and a spindle 18, can be seen to be mounted within the nose 20 of the unit 10 for rotation relative to the nose, and each other, about a first axis 22. A ball bearing 24 supports one end of the case 16 for rotation about the first axis. A bushing 26 supports a portion of the spindle 18 for rotation about the first axis at the front end of the nose 20. The case and spindle are mutually supported for rotation about the first axis by an extension 28 of the spindle received in a recess 30 in the case 16 and between a pressure plate 32 fixed to the case 16 with an aperture 34 to support the spindle 18.

A cylindroidal cavity 36 of predetermined length L is formed into the case 16. As best seen in FIGS. 3, 4, 7-9, 11 and 12, the wall 38 of the cavity has a generally elliptical cross section perpendicular to the first axis with a major axis 40 and a minor axis 42. The cross section remains uniform along the entire length L of the cavity 36. The cavity is formed by drilling three overlapping and parallel cylindrical bores into one end of the case 16. The centerlines of the bores lie along a single line corresponding to the major axis 40, with the axis of the centermost bore coinciding with the first axis 22. The wall 38 forms a first seal land 44 which extends the length of the cavity on the minor axis 42. A second seal land 46 is also formed along the length of the cavity on the minor axis 42 on the opposite side of the first axis from the first seal land 44. Four pockets 48, 50, 52 and 54 are formed into the wall 38 in a center portion of the cavity, as best seen in FIG. 14, with the pockets ending before end sections 56 and 58 of the cavity.

The section 60 of the spindle 18 within the cavity 36 has a generally square cross section. One pair of opposed edges of the square cross section define a first seal land 62 and a second seal land 64. The lands 62 and 64 are preferably formed by a milled relief in the outer surface of the spindle. At the other pair of edges are formed a first recess 66 and a second recess 68 extending the length of cavity 36 and having a general U-shaped cross section.

A passage 70 is provided through the section 60 which opens into recesses 66 and 68. The passage 70 is positioned at about the middle of the section 60 and extends generally perpendicular the first axis 22. Another passage 72 (see FIGS. 1 and 14) is formed through the section 60 between passage 70 and extension 28 and opens through opposite faces 74 and 76 of the section. A third passage 78 extends through the section 60 between passage 70 and plate 32 which opens through faces 80 and 82 of the section 60.

A first cylindrical roller 84 is positioned in the first recess 66, and roller 84 has a length substantially equal the length of the cavity 36. A second cylindrical roller 86 is positioned in the second recess 68 and has a length also substantially equal to the length of the cavity 36. A spring assembly 88 extends through passage 70 to urge both rollers 84 and 86 outward against the wall 38 of the cavity 36. The spring assembly 88 includes a coil spring 90 with contact buttons 92 at each end of the spring.

The surface 94 defines one end of the cavity 36. The other end is defined by the inner side 96 of pressure plate 32. The pressure plate is positioned within a recess 98 formed within the case and fixed in place by a threaded end cap 100. An O-ring seal 102 acts between the outer periphery of the pressure plate and the inner surface of the case.

The spaces between the outer surface of the spindle and the inner walls of the case are filled with a fluid 104. The fluid is kept slightly pressurized by a springloaded accumulator piston 106, positioned in the end cap 100 for limited sliding motion relative to the cap and to the outer surface of the spindle 18. An O-ring 108 seals the accumulator piston 106 to the spindle, while an O-ring 110 seals the piston 106 to the inside of end cap 100. A pair of finger springs 112 act between the end cap and the piston 106 to urge the piston 106 toward the pressure plate 32, slightly pressurizing the fluid 104.

The protruding section of the spindle 18 has a concentric passage 114 which extends into the spindle and connects the passage 78. A portion of passage 114 is threaded and receives an output adjustment screw 116. O-rings 118 are fit between the screw 116 and the passage 114 to prevent fluid leakage exterior the unit. A passage 120 is formed through the spindle which opens through faces 74 and 76 and which interconnect the passage 78 through passage 114 as best seen in FIGURe 14. The inner end 122 of screw 116 is tapered so that, as the screw moves inward, it covers a certain portion of the passage 120 to control fluid flow between passages 78 and 120.

With reference now to FIG. 3, the operation of the impulse unit 10 will be described. As shown in FIG. 3, the case and spindle are oriented in what is arbitrarily defined as a zero degree relationship. At zero degrees, the first seal lands 62 and 44 are aligned and the second seal lands 46 and 64 are aligned. This alignment effectively defines four isolated chambers, A, B, C and D as shown. Fluid 104 fills each of these chambers due to the action of piston 106 and springs 112.

As the case 16 is rotated in the direction of arrow 124 relative to the spindle 18, the fluid in chambers B and D can not leak to chambers A and C sufficiently fast to prevent an increase in the pressure of the fluid within chambers B and D. This pressure rise fluidically couples the case 16 to the spindle 18 and causes the spindle 18 to rotate with the case. Passages 70 and 78 provide for cross flow between chambers B and D to equalize the force exerted between the case and spindle.

Chambers B and D form two completely symmetric pressurized oil entrapment chambers, spaced 180° from each other about the axis 22. Due to the symmetry of the chambers, the volumetric changes in the chambers coincide exactly as the case rotates relative to the spindle, providing a high torque output while reducing internal journal bearing loads, reducing vibration, and reducing mechanical wear between moving parts.

Figure 7:
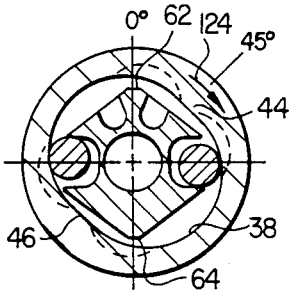
FIG. 7 is the cross sectional view of FIG. 4 with the case moved 45° from the impulse generating position relative the spindle.
Figure 8:
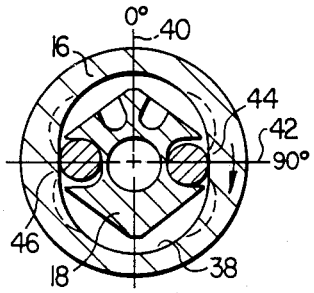
FIG. 8 is the cross sectional view of FIG. 4 with the case moved 90° from the torque generating orientation.
Figure 12:
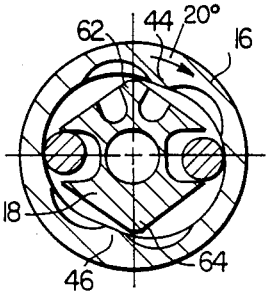
FIG. 12 is the cross sectional view of FIG. 4 with the case rotated 20° beyond the torque impulse generating position.

To transfer the maximum torque between the case and spindle, the screw 116 would be threaded into passage 114 to completely isolate passage 120 from passage 78. Thus, the fluidic coupling between the case and spindle would exist until sufficient fluid has leaked from chambers B and D to the lower pressure chambers A and C past the various mating surfaces of the spindle, cylindrical rollers 84 and 86 and case wall 38 to move the case sufficiently relative to the spindle to move the seal lands out of alignment and suddenly depressurize the fluid in chambers B and D to decouple the spindle and case. As seen in FIGS. 12 and 7, as the case rotates from zero to about 180° from the spindle, there is no tendency for pressure build-up in the system and the case rotates freely relative to the spindle.

Figure 9:
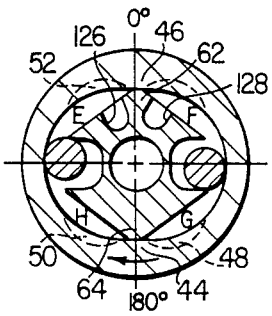
FIG. 9 is the cross sectional view of FIG. 4 with the case rotated 180° from the torque generating position.
Figure 10:
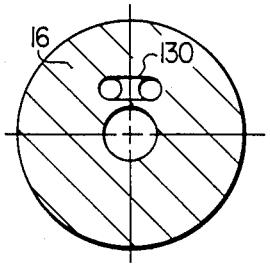
FIG. 10 is the cross sectional view of FIG. 5 with the case rotated 180° relative to the spindle from the torque impulse generating position.
Figure 11:
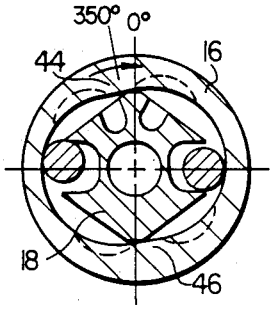
FIG. 11 is the cross sectional view of FIG. 4 with the case rotated 350° relative to the spindle from the torque impulse generating position.

With reference to FIG. 9, as the case approaches 180° rotation relative to the spindle, a potential for a second fluidic coupling environment is created. As seen in FIG. 9, the alignment of the first seal land 44 and second seal land 64 and the second seal land 46 and first seal land 62 creates isolated chambers E, F, G and H. However, a series of bypass passages 126, 128 and 130 are aligned in this relative angular orientation to connect chambers E and F. With the alignment of passages 126, 128 and 130, in conjunction with the passages 70, 72 and 78, there is created a cross flow between all of the chambers. This prevents any significant pressure build up in the system and the case will continue to rotate freely relative to the spindle to a rotational angle of about 350°, as seen in FIGURE 11, before the first seal lands and second seal lands again align at the 360° or zero degree alignment for the next impulse.

Figure 13:
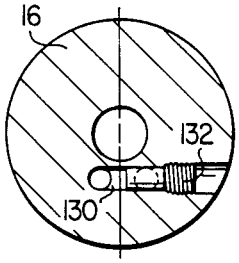
FIG. 13 is the cross sectional view of FIG. 5 illustrating the blockage of a bypass passage to generate two torque impulses per relative rotation between the case and spindle.

As can be readily understood, the use of passages 126, 128 and 130 provides one torque impulse for every 360° rotation of the case 16. Should two pulses be desired per rotation of the case 16, the passage 130, formed in case 16, can be blocked by a plug 132 as seen in FIG. 13. With such a plug, passages 128 and 130 are isolated and pressure builds in chambers F and H in the same manner as chambers B and D described previously. As with chambers B and D, chamber F and H are totally symmetric, maximizing the efficiency of the tool.

By adjusting the position of screw 116, the output torque transferred to the spindle can be reduced to any desired fraction of the maximum torque output of the unit. Essentially, the screw 116 varies the cross sectional area of the connection between passages 78 and 120 to control the rate of flow from pressurized chambers B and D to the unpressurized chambers A and C, thus limiting the extent of fluid coupling. The pockets 48, 50, 52 and 54 are utilized to bypass fluid both before and after the seal lands align to increase the sharpness of the impulse conveyed between the case and the spindle 18.

As will be understood, the use of two opposed seal lands and two opposed parallel rollers in the internal configuration of the case and spindle provide completely symmetric pressurized fluid entrapment chambers whether one or two torque impulses per revolution of the case are provided. Such a symmetric pattern reduces wear, frictional generation, vibration and heat generation, thereby increasing the efficiency of the unit.

Tremendous manufacturing flexibility is provided in the selection of one or two impulse units. For example, the case could be made without a passage 130, the spindle could be made without passages 126 or 128, or a plug 132 can be positioned in any of the passages to convert a single impulse unit to a dual impulse unit.

The use of cylindrical rollers provides for simplified milling, grinding and measurement of component parts as compared with conventional flat metal blades currently employed in hydraulic impulse tools to significantly reduce manufacturing costs. The rollers continuously present a variety of surfaces to the wall 38 and recesses 66 and 68. This produces a bright, mirrorlike polish on the rollers and buffs the contact surfaces of the rollers to lower friction, reduce scoring, and improve oil sealing capability. Also, the viscous hydrodynamic forces against the rollers will decrease rubbing and wear between the rollers and the wall 68 of the case as the rollers are forced radially inward between pulses. Flat metal blades are used in prior art devices must be "crowned" or "bevelled" to produce this viscous support. Also, prior art flat metal blades may "cock" or "bind" within their support slots as they are moving radially while loaded hydrostatically. Also, the use of cylindrical rollers eliminates the need for the long, slender coil springs often used with such flat blades, which makes tool assembly difficulty without buckling the blades.

While the adjusting screw 116 is illustrated with access from the front of the unit, revisions can be made to adjust the screw from the rear of the unit if desired. The adjustment screw could also be placed in other locations in the case, for example, within the body of the spindle, if desired.

The unit is completely symmetric and can be operated in the reverse direction (opposite arrow 124) in exactly the same manner as operation in the forward direction. If controllable torque impulse is desired in the forward direction, while full torque impulse in the reverse direction is desired, on or two ball check, poppet check or flap check flow valves can be built into the spindle 18 connecting passages 78 and 120 to deliver a full reverse pulse regardless of the position of the adjustment screw 116.

Although only a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the scope and spirit of the invention.

I claim:

1. An impulse unit, comprising:

a case defining an interior cavity of predetermined length centered on a first axis, the wall of the cavity having a generally elliptical cross section perpendicular to the first axis with mutually perpendicular minor and major axes, the wall defining first and second seal lands on opposite sides of the first axis along the minor axis, each extending the entire length of the cavity;

a spindle mounted to the case for relative rotation between the case and spindle about the first axis, the spindle extending through the cavity and having an outer surface, the outer surface defining first and second seal lands thereon on opposite sides of the first axis, the spindle further having a first recess formed therein through the outer surface, the first recess extending parallel the first axis the length of the cavity on one side of the first axis between the first and second seal lands on the spindle, and a second recess formed therein through the outer surface, the second recess extending parallel the first axis the length of the cavity on the opposite side of the first axis from the first recess between the first and second seal lands on the spindle;

a first cylindrical roller having a length equal to the length of the cavity and partly received within the first recess of the spindle for simultaneous contact with the surface of the first recess and the wall of the cavity;

a second cylindrical roller having a length equal to the length of the cavity and partly received within the second recess for simultaneous contact with the surface of the second recess and the wall of the cavity;

means for maintaining a fluid in the spaces between the wall of the cavity and the outer surface of the spindle; and means for rotating the case and spindle relative each other about the first axis, alignment of the first seal lands on the case and spindle and the second seal lands on the case and spindle temporarily isolating a first pair of chambers formed between the spindle and case from a second pair of chambers formed between the spindle and case to fluidically couple the case and spindle for joint rotation to transfer a torque impulse therebetween until sufficient fluid passes between the first pair of chambers to the second pair of chambers to misalign the seal lands and decouple the case from the spindle.

2. The impulse unit of claim 1 further having a passage formed through the spindle to interconnect the first pair of chambers to provide a symmetric torque output.

3. The impulse unit of claim 1 further having means to urge each cylindrical roller against the wall of the cavity within the case.

4. The impulse unit of claim 1 wherein the case further has pockets formed into the wall of the cavity within the first pair of chambers to enhance the torque impulse transfer.

5. The impulse unit of claim 1 further having means for controlling the fluid passage between the first pair of chambers and the second pair of chambers to limit the torque impulse transferred between the case and spindle.

6. The impulse unit of claim 1 wherein alignment of the first seal land on the case with the second seal land on the spindle and alignment of the first seal land on the spindle with the second seal land on the case isolates a third pair of chambers between the spindle and case from a fourth pair of chambers between the spindle and case to pressurize the fluid in the third pair of chambers to fluidically couple the case and spindle for joint rotation to transfer a second torque impulse therebetween until sufficient fluid passes between the third pair of chambers to the four pair of chambers to misalign the seal lands and decouple the case and spindle to provide two torque impulses per a complete relative rotation between the case and spindle.

7. The impulse unit of claim 1 further having means for interconnecting a third pair of chambers with a fourth pair of chambers formed when the first seal land of the case aligns with the second seal land of the spindle and the first seal land of the spindle aligns with the second seal land of the case to prevent fluidic coupling so that a single torque impulse is transferred for a complete relative between the case and spindle.

8. An impulse unit comprising:

a case defining an interior cylindroidal cavity of predetermined length centered on a first axis, the wall of the cavity having a generally elliptical cross section perpendicular to the first axis with a minor axis and a major axis, the wall of the cavity defining first and second seal lands on opposite sides of the first axis and on the minor axis the seal lands extending the length of the cavity;

a spindle mounted to the case for relative rotation between the case and spindle about the first axis, the spindle having a portion extending through the interior cavity of the case, the portion having a generally square cross section perpendicular the first axis, a first seal land being formed at the edge between a first face and a second face of the spindle portion and a second seal land formed on the opposite edge of the spindle between a third face and a fourth face thereof, a first U-shaped recess formed into the spindle at the edge between the first face and the fourth face and a second U-shaped recess formed at the opposite edge between the second face and third face, each of the Ushaped recesses extending parallel the first axis the entire length of the cavity, a spring passage formed through the spindle portion generally perpendicular the first axis and opening into each recess;

a first cylindrical roller having a length equal to the length of the cavity and partly received within the first recess of the spindle for contact with the surface of the first recess and the wall of the cavity;

a second cylindrical roller having a length equal to the length of the cavity and partly received within the second recess of the spindle for contact with the surface of the second recess and the wall of the cavity;

a spring positioned in the spring passage within the spindle and acting between the first and second cylindrical rollers to urge the rollers into contact with the wall of the cavity;

means for maintaining a fluid between the wall of the cylindrical passage and the spindle portion; and means for rotating a selected one of the case and spindle relative the other about the first axis, alignment of the first seal lands and the second seal lands isolating a first pair of chambers between the case and spindle from a second pair of chambers between the case and spindle to fluidically couple the case and spindle for joint rotation to transfer a torque impulse until sufficient fluid passes between the first pair of chambers to the second pair of chambers to misalign the seal lands and decouple the case and spindle.

9. The impulse unit of claim 8 having a first passage formed through the spindle portion and opening through the first and third faces thereof.

10. The impulse unit of claim 9 having a second passage through the spindle portion opening through the second and fourth faces thereof.

11. The impulse unit of claim 9 further having means for controlling release of fluid from the first passage to the second pair of chambers to limit the torque transfer between the case and spindle.

12. The impulse unit claim 8 further having pockets formed within the wall of the cavity to increase the volume of the first pair of chambers to enhance the torque transfer between the case and spindle.

13. The impulse unit claim 8 further having bypass passages formed in the spindle and case aligned when the first seal land of the spindle is aligned with the second seal land of the case and the second seal land of the spindle is aligned with the first seal land of the case to provide free fluid passage between a third pair of chambers and a fourth pair of chambers formed by the alignment to limit the impulse unit to a single transfer of torque impulse for every relative rotation between the case and spindle.

14. The impulse unit claim 13 further having means for blocking one of said bypass passages to create a second torque impulse transfer for each relative rotation between the case and spindle.

* * * * *

UNITED STATES PATENT AND TRADEMARK OFFICE

CERTIFICATE OF CORRECTION

PATENT NO. : 4,836,296

DATED : June 6, 1989

INVENTOR(S) : Paul A. Biek

It is certified that error appears in the above-identified patent and that said Letters Patent is hereby corrected as shown below:

Column 4, line 49, delete "the" and insert --with--.

Column 4, line 55, delete "FIGURe" and insert --FIGURE--.

Column 8, line 4, delete "four" and insert --fourth--.

Column 8, line 23, delete the second "axis" and insert --axis,--.

Column 8, line 38, delete "Ushaped" and insert --U-shaped--.

Signed and Sealed this

Twentieth Day of July, 1993

*Attest:*

Michael K. Kirk

MICHAEL K. KIRK

*Attesting Officer*

*Acting Commissioner of Patents and Trademarks*